United States Patent [19]

Kitagawa

[11] 4,185,529

[45] Jan. 29, 1980

[54] ELECTRONIC MUSICAL INSTRUMENT

[75] Inventor: Hiroshi Kitagawa, Hamamatsu, Japan

[73] Assignee: Kabushiki Kaisha Kawai Gakki Seisakusho, Hamamatsu, Japan

[21] Appl. No.: 856,359

[22] Filed: Dec. 1, 1977

[30] Foreign Application Priority Data

| | | | |
|---|---|---|---|
| Dec. 2, 1976 | [JP] | Japan | 51/144956 |
| Dec. 2, 1976 | [JP] | Japan | 51/144957 |
| Dec. 2, 1976 | [JP] | Japan | 51/144958 |
| Dec. 7, 1976 | [JP] | Japan | 51/146706 |
| Dec. 7, 1976 | [JP] | Japan | 51/146707 |
| Dec. 7, 1976 | [JP] | Japan | 51/146708 |

[51] Int. Cl.[2] ..... G10H 1/06; G10H 5/10

[52] U.S. Cl. ..... 84/1.01; 84/DIG. 9; 84/DIG. 10; 84/1.19; 84/1.24; 84/1.26; 364/724; 364/721

[58] Field of Search ..... 84/1.01, 1.03, 1.11, 84/1.12, 1.13, 1.19, 1.21, 1.22, 1.23, 1.24, 1.26, 1.27, DIG. 8, DIG. 9, DIG. 10; 340/365 S; 364/718, 721, 724

[56] References Cited

U.S. PATENT DOCUMENTS

| | | | |
|---|---|---|---|
| 3,899,951 | 8/1975 | Griffith | 84/1.01 |
| 3,981,217 | 9/1976 | Oya | 84/1.01 |
| 4,022,098 | 5/1977 | Deutsch | 84/1.01 |
| 4,079,650 | 3/1978 | Deutsch | 84/1.01 |
| 4,114,495 | 9/1978 | Tomisawa | 84/1.01 |

*Primary Examiner*—Gene Z. Rubinson
*Assistant Examiner*—William L. Feeney

[57] ABSTRACT

A digital organ or like electronic musical instrument of a real time processing system which produces musical notes by synthesizing weighted square waves and applying them to a digital filter of a transfer characteristic controlled for each square wave. Key information from a keyboard is detected by a key code generator having a key switch matrix in which key switches are grouped into a plurality of blocks. The key switches are scanned for each block and when one or more key switches of the block are closed, the scanning is stopped until after the closure information is sent out as binary coded information to a key code data assignor in accordance with priority. The key code data assignor applies envelope control signals to an envelope generator and an N-degree square wave generator. The envelope generator is a cyclic digital filter whose filter constant is controlled to provide desired envelope waveshape data for input to a multiplier. The square wave generator accumulates angular velocity information to generate a square wave signal SQU(N) of a period T/10 from a square wave signal of a fundamental period T. In a square wave memory, a square wave level designated by a tablet draw bar switch is calculated to read out a level coefficient value $A_N$ which is inverted and gated by the square wave signal SQU(N) to provide an N-degree square wave $A_N$SQU(N) for input to a cyclic digital filter whose filter constant is controlled in accordance with the input signal $A_N$SQU(N) to provide a waveshape $f_N[A_N SQU(N)]$ for input to the multiplier. The output from the multiplier is accumulated by an accumulator for each degree and channel and a waveshape h(t) for each sample is applied via a D-A converter to a sound system.

12 Claims, 26 Drawing Figures

FIG. 8A $\phi_{21}$
FIG. 8B $\phi_{23}$
FIG. 8C COUNTER 1 2 3 4 5 6 1 2 3 4 5 6 1 2
FIG. 8D NC 1 5 10 3 5 8 1 5 10 5 1 5
FIG. 8E OC 6 1 2 3 4 5 6 1 2 3 4 5 6 1 2
FIG. 8F FS
FIG. 8G OC
FIG. 8H NC

ELECTRONIC MUSICAL INSTRUMENT

BACKGROUND OF THE INVENTION

1. Field of the Invention

This invention relates to an electronic musical instrument which is provided with a key code generator of a variable frame which provides for a shortened time for scanning key switches to detect closed ones of them.

2. Description of the Prior Art

In a device which has a large number of key switches, such as the keyboard of an electronic musical instrument, direct connection of the key switches to internal circuits for transferring information on the opening and closure of the switches to a desired one or ones of the circuits inevitably involves an enormous amount of wiring, and hence is uneconomical. Also, the use of semiconductor integrated circuits or the like is difficult because of too large a number of pins.

In view of the above, there has recently been proposed a system which scans all key switches in a predetermined period of time and generates a pulse at the moment corresponding to a closed one of the key switches for each time sequence of the scanning, thereby to save connections between the key switches and required circuits. For example, a key code multiplex system is usually employed in which information of a closed key switch detected by scanning the key switches on a time sharing basis is sent in the form of a TDM (Time Division Modulation) or PCM (Pulse Code Modulation) signal. With this system, however, the time for scanning all the key switches is fixed and this fixed scanning time is always required regardless of the number of key switches being closed, so that the scanning time is consumed wastefully in somes cases.

The maximum number of keys which can be depressed simultaneously with both hands and a foot in the playing of an ordinary keyboard instrument is eleven. Assuming that blocks into which the keys are divided each correspond to one octave, it is impossible to depress the keys of more than two octaves with one hand, and accordingly the maximum number of blocks simultaneously occupied is five. Accordingly, it is possible to employ such a method in which the key switches are scanned for each block of them and if a key switch or switches are closed, the scanning is stopped for the detection of them. Since the scanning is not stopped in the block in which no key switches are closed, one scanning time for obtaining information of closed key switches can be shortened.

SUMMARY OF THE INVENTION

An object of this invention is to provide a digital organ of a real time processing system in which waveshape synthesis is accomplished by the waveshape conversion of square waves with the use of a cyclic digital filter.

Another object of this invention is to provide an electronic organ which has a key code generator to provide for shortened time for scanning of all key switches.

Another object of this invention is to provide an electronic musical instrument which has a key assignor which receives a key code of a variable frame from a key code generator to generate time divided key codes corresponding to a plurality of channels for each frame.

Another object of this invention is to provide an electronic musical instrument which has a simple-structured overflow control circuit fit for time divided envelope data controlled by a key code assignor.

Another object of this invention is to provide an electronic musical instrument which has a simple-structured envelope generator which generates an envelope waveshape smooth at its attack and release with a small memory capacity.

Another object of this invention is to provide a simple-structured electronic musical instrument which synthesizes a desired musical note with small number of original waveshapes.

Still another object of this invention is to provide an electronic musical instrument which has a simple-structured square wave level memory unit which shortens the time for reading out the square wave level corresponding to closure information of a tablet switch.

Other objects, features and advantages of this invention will become apparent from the following description taken in conjunction with the accompanying drawings.

DESCRIPTION OF THE PREFERRED EMBODIMENTS

Figure 1:
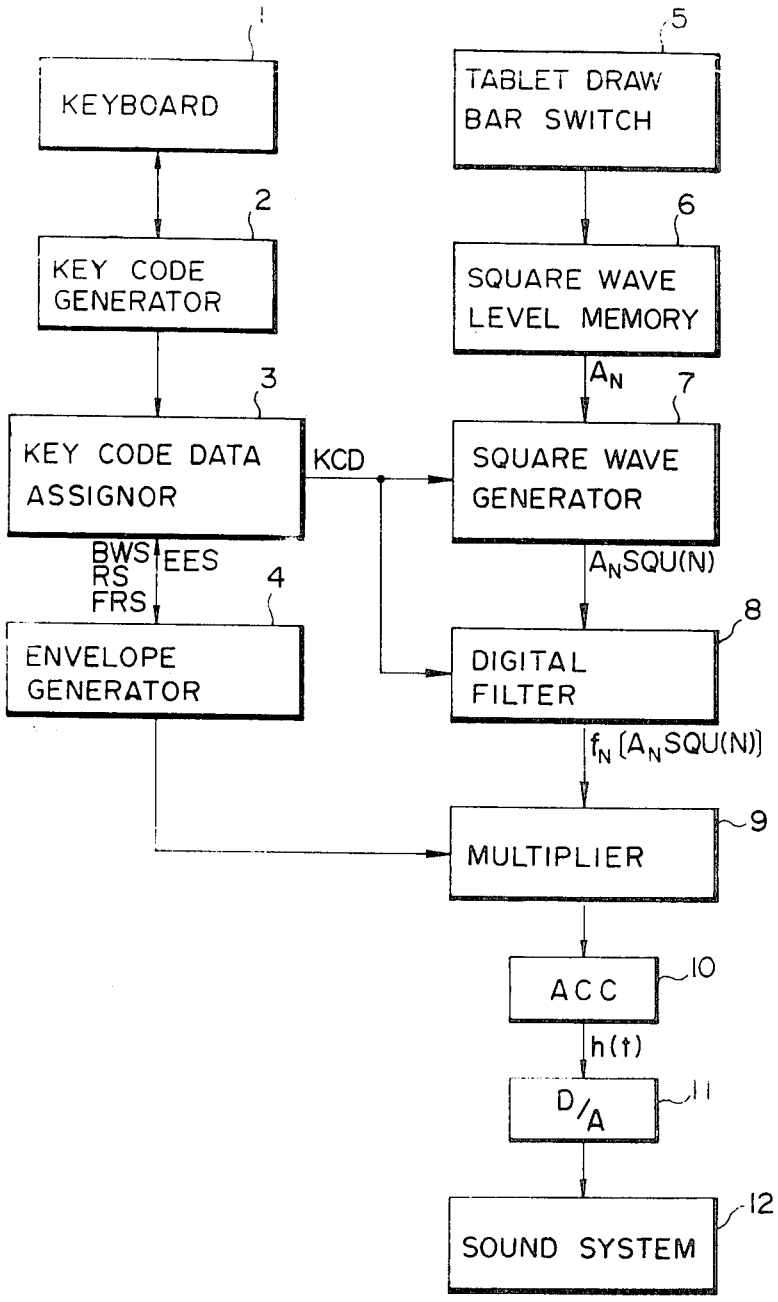
FIG. 1 is a block diagram showing the outline of an embodiment of the electronic musical instrument.

The following description will be given first of the outline of an embodiment of a novel electronic musical instrument of this invention and then details of examples of respective parts of the embodiment.

The electronic musical instrument of this invention is designed to produce a desired musical note with a small number of constituent waveshapes by the combined use of a system of synthesizing square waves respectively weighted with coefficients, instead of a conventional system of synthesizing pure sine waves, and a digital filter of an appropriate coefficient.

The principles and the structure of this invention will be outlined. If a musical note is assumed to have a periodic waveshape h(t), it is expressed by the following expansion of the Fourier series:

$$h(t) = \sum_{n=1}^{n=\infty} a_n \sin n\omega t.$$

If the periodic waves of up to 30th harmonic are each sampled at time intervals of $\tau$, it follows that $$h(\omega\tau) = \sum_{n-1}^{n=30} a_n \sin n\omega\tau.$$

If the waveshapes of up to the 30th harmonic are calculated on a time shared basis in synchronism with the musical note and if eight notes are simultaneously produced, a clock of at least 28.8 MHz is required in the case of a musical note of 2 KHz. The clock frequency can be lowered down to about 7.2 MHz by suppressing higher harmonics for the high frequency range but the circuit therefor is complicated and the circuit integration is still difficult.

Then, it is considered to utilize harmonic distortion by employing a musical waveshape synthesizing system which is basically equivalent to the sine wave synthesizing system but uses square waves in place of pure sine waves. That is, a low-degree sine wave is produced by applying a square wave to a filter of a large filter constant and a middle-degree sine wave is produced by applying a square wave to a filter of a small filter constant, thereby to generate a harmonic distortion, and a high-degree sine wave is supplemented by approximation. With this method, a musical waveshape is synthesized with square waves of 15th or lower harmonics whereas the prior art requires sine waves of up to 30th harmonic.

Let the square wave be represented by SQU(NT). If weighted waveshapes $A_1SQU(\omega T)$, $A_2SQU(\omega T)$, . . . $A_NSQU(\omega T)$ are produced and are each applied to a filter whose constant increases with a decrease in the degree of the wave, the following waveshapes are provided.

$$F_1[A_1SQU(\omega T)] \approx k_1 \sin\omega T$$
$$F_2[A_2SQU(\omega T)] \approx k_{21}\sin 2\omega T + k_{22}\sin 6\omega T$$
$$\vdots$$
$$F_N[A_NSQU(\omega T)] \approx k_{N1}\sin N\omega T + k_{N2}\sin 3N\omega T + k_{N3}\sin 5N\omega T \ldots\ldots$$

For instance, in the case of square waves of up to N=10, waveshapes of up to 10th harmonic are reproduced substantially completely. By the harmonic distortion, many harmonics 12th, 15th, 18th, . . . 30th are produced. If the harmonics which determines the tone of a musical note are those up to 10th or so, a musical waveshape desired to obtain can be realized by approximation. In other words, the prior art requires synthesizing of sine waves of up to 30th harmonic whereas in this invention it is sufficient to synthesize square waves of up to 10th harmonic which is $\frac{1}{3}$ that needed in the prior art. The clock frequency necessary therefor may be about 2.4 MHz. It is evident that this clock frequency can be lowered down to $\frac{1}{2}$, $\frac{1}{3}$, . . . by parallel processing.

FIG. 1 is an explanatory diagram showing the construction of an embodiment of the electronic musical instrument of this invention based on the abovesaid principles. In FIG. 1, reference numeral 1 indicates a keyboard, and 2 designates a key code generator in which key switches of make contacts of sixty-one keys are divided into six blocks, each including twelve keys of one octave. That is, the key switches are arranged in the form of a (12×6) matrix. Key information is obtained by scanning each block of the key switches with the key code generator 2 and when the block includes a closed key switch or switches, the block scanning is temporarily stopped until the key information of the block is sent out. The key information of the closed key switches is selectively outputted sequentially in accordance with priority of the closed keys. The time slot required therefore is limited to the number of closed key switches and the number of blocks, for example, if five keys are depressed, one scanning time slot is 5+6=11. The key "ON" information thus obtained is outputted in the form of a binary-coded key code corresponding to each key switch, and is applied to a key code data assignor 3 together with a frame signal indicative of completion of one scanning. The key code data assignor 3 has eight channels which is the maximum number of sounds simultaneously produced, and performs a high-speed time dividing operation of dividing one time slot of the key code data into eight. A control operation of the key code data assignor 3 is carried out at the time of the frame signal to supply an envelope generator 4 with an envelope control signal, that is, a content presence or absence signal (BWS), a release signal (RS), a high-speed release signal (FRS), an envelope end signal (EES), ets. and an N-order square wave generator 7 with a key code data KCD which is frequency information. The envelope generator 4 is formed with a cyclic digital filter, which outputs a desired envelope waveshape data by controlling an input signal and a filter constant determining the filter characteristic and supplies the output to a multiplier 9. The square wave generator 7 accumulates angular velocity information read out by the key code data KCD to generate from a square wave signal of a fundamental period T a square wave signal SQU(N) of a period T/10 in one channel time slot on a time-shared basis. In a square wave level memory 6 for determining a sound, a square wave level designated by a tablet draw bar switch 5 is calculated and a level coefficient value $A_N$ is read out of the square wave level memory 6 in synchronism with the abovesaid square wave signal. The level coefficient value $A_N$ is inversely gated by the square wave signal SQU(N) and the resulting weighted N-degree square wave $A_N$-SQU(N) is inputted to a digital filter 8 in the time divisional manner. The digital filter 8 is formed with a cyclic digital filter, whose filter constants determining the filter characteristics are selectively read out in accordance with the musical scale and the degree of the input square wave. The input signal $A_NSQU(N)$ is thus filtered by the digital filter 8 to output therefrom a waveshape $f_N[A_NSQU(N)]$ in the time divisional manner for input to the multiplier 9. In the multiplier 9, an envelope is added to each channel and each order. The output from the multiplier 9 is accumulated by an accumulator (ACC) 10 for each degree and for each channel and a waveshape h(t) of each sample is applied to a D-A converter 11 and then to a sound system 12 to produce a musical note.

Figure 2:
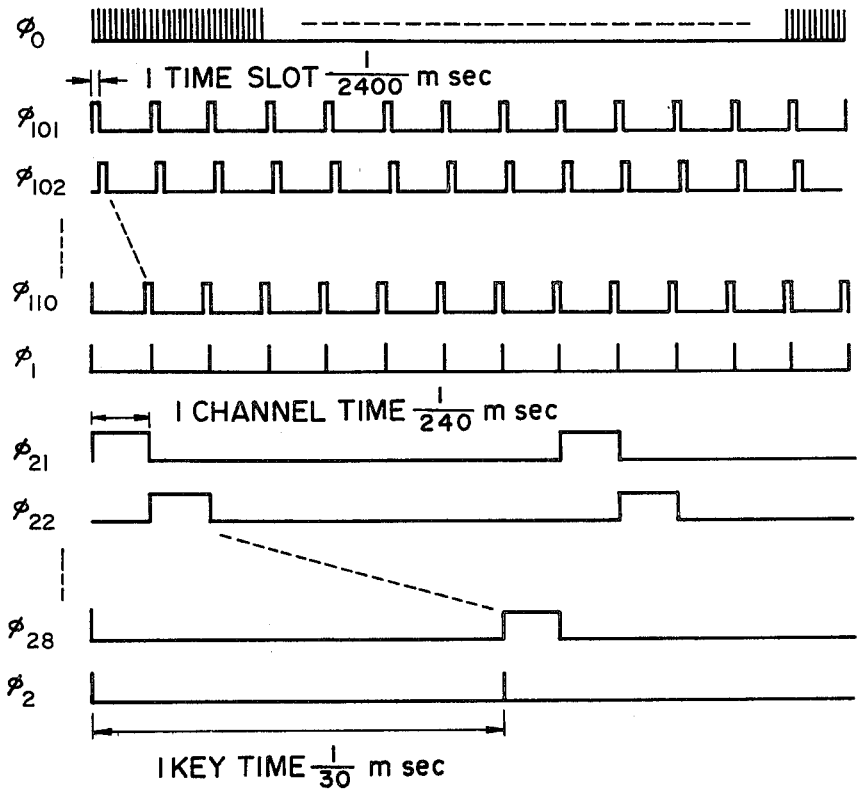
FIGS. 2 and 3 show fundamental timing waveforms for use in the electronic musical instrument of FIG. 1 and a generator for providing the timing waveforms.

FIG. 2 shows fundamental timing waveshapes of the electronic musical instrument depicted in FIG. 1. Reference character $\phi_0$ indicates a master clock having a frequency of 2.4 MHz; $\phi_{101}$ to $\phi_{110}$ show time slots for the square wave generation, which are time divided into ten time slots corresponding to square waves SQU(1) to SQU(10), one time slot being 1/2400 ms.; and $\phi_{21}$ to $\phi_{28}$ show time slots which are time divided into eight channels corresponding to the time divided key code data TKCD outputted from the key code data assignor 3, each time slot being 1/240 ms. The operating speed of the key code generator 2 is the time slot of one key time 1/30 ms. and at this timing all the circuits perform their time divided operations.

Figure 3:
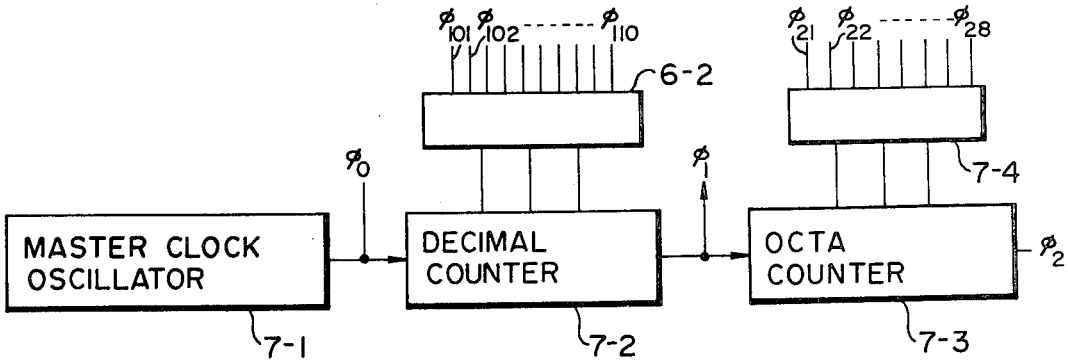

FIG. 3 illustrates a clock generator included in the square wave generator 7 for generating the fundamental timing waves depicted in FIG. 2. A master clock oscillator 7-1 provides the clock $\phi_0$, which is applied to a decimal counter 7-2 to derive the timing clocks $\phi_{101}$ to $\phi_{110}$ from a decoder 6-2. Next, the output pulse $\phi_1$ from the counter 7-2 is fed to an octal counter 7-3 to output the timing clocks $\phi_{21}$ to $\phi_{28}$ from a decoder 7-4 and the counter 7-3 outputs a pulse $\phi_2$ which is used for various functions.

Figure 4:
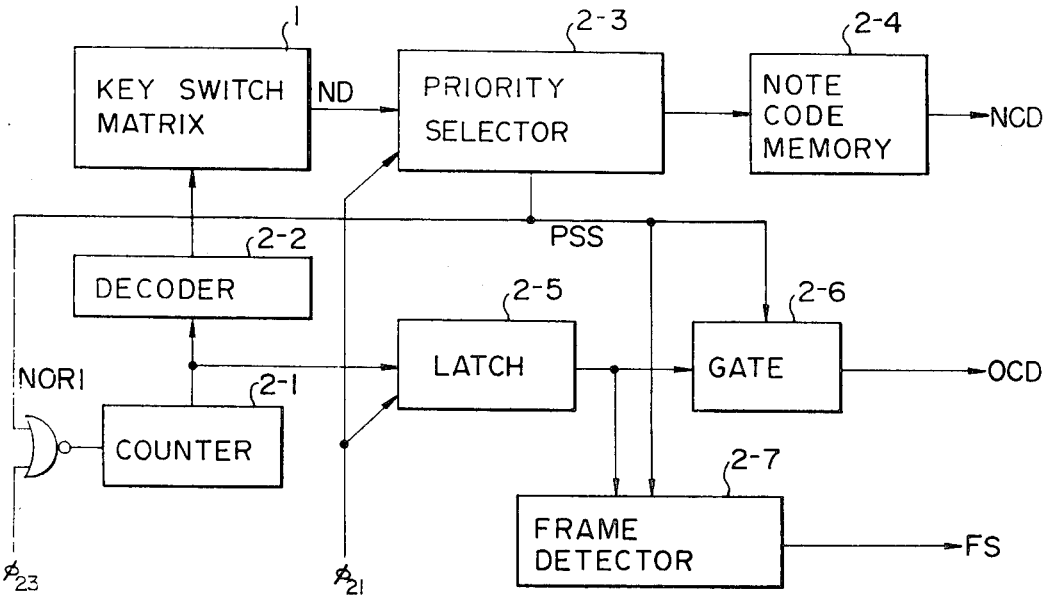
FIG. 4 is a block diagram illustrating an example of a key code generator 2 used in the embodiment of FIG. 1.

FIG. 4 shows in detail an example of the key code generator 2 for use in the electronic musical instrument depicted in FIG. 1. In FIG. 4, a key switch matrix 1 is composed of sixty-one make contact switches, which are divided into six octave blocks, each including twelve key switches of one octave. The clock $\phi_{23}$ is applied to a modulo 6-step counter 2-1 via an NOR gate NOR1 and the output from the counter 2-1 is applied to a decoder 2-2 to scan the key switch matrix 1 for each block. A key data ND outputted from the key switch matrix 1 is fed to a priority selector 2-3. Where closed key switches are present, the key data ND is outputted one by one by the abovesaid clock $\phi_{21}$ in accordance with predetermined priority and applied to a note code memory 2-4 to provide therefrom note code data NCD in a sequential order. During the selective outputting, the priority selector 2-3 provides a signal PSS to apply "1" to the NOR gate NOR1, temporalily stopping the operation of the counter 2-1. When all the key information of the closed key switches has been outputted, the signal PSS becomes "0", permitting the passage of the aforesaid clock $\phi_{23}$ through the NOR gate NOR1 to the counter 2-1 to start scanning of the next block. In this manner, the key switches are sequentially scanned, with the block scanning being temporarily stopped. The output from the counter 2-1 is applied to a latch circuit 2-5 to be latched therein by the clock $\phi_{21}$ to provide timing with the note code data NCD from the note code memory 2-4. The output from the latch circuit 2-5 is applied to a gate 2-6 and is gated by the signal PSS to provide an octave code data OCD. The note code data NCD and the octave code data OCD will hereinafter be referred to as the key code data KCD. Next, the time when the octave code data becomes "110" (6 in the decimal notation) and the time when the signal PSS from the priority selector 2-3 becomes "0" are detected by a frame detector 2-7 to provide a frame signal FS.

Figure 5:
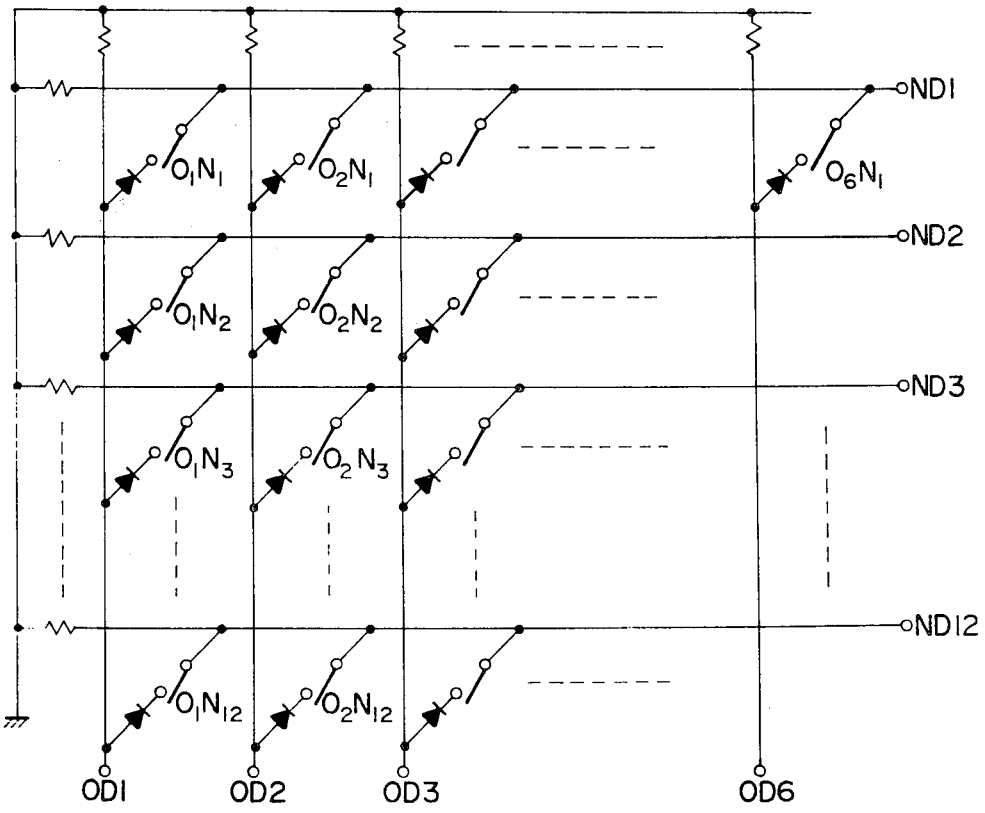
FIGS. 5 to 7 are detailed circuit diagrams respectively showing the principal parts of the example of FIG. 4.

FIG. 5 shows in detail an example of the circuit of the key switch matrix 1 used in the key code generator depicted in FIG. 4. Two sets of bus lines $OD_1$ to $OD_6$ and $ND_1$ to $ND_{12}$ are grounded via resistors, respectively. At the intersecting points of the two sets of bus lines there are connected sixty-one key switches $O_1N_1$ to $O_6N_{12}$ through diodes, respectively. When the bus lines $OD_1$ to $OD_6$ for the octave are sequentially scanned, "1" is provided on those of the bus lines $ND_1$ to $ND_{12}$ which correspond to closed ones of the key switches of the octave blocks. This output is applied to the priority selector 2-3.

Figure 6:
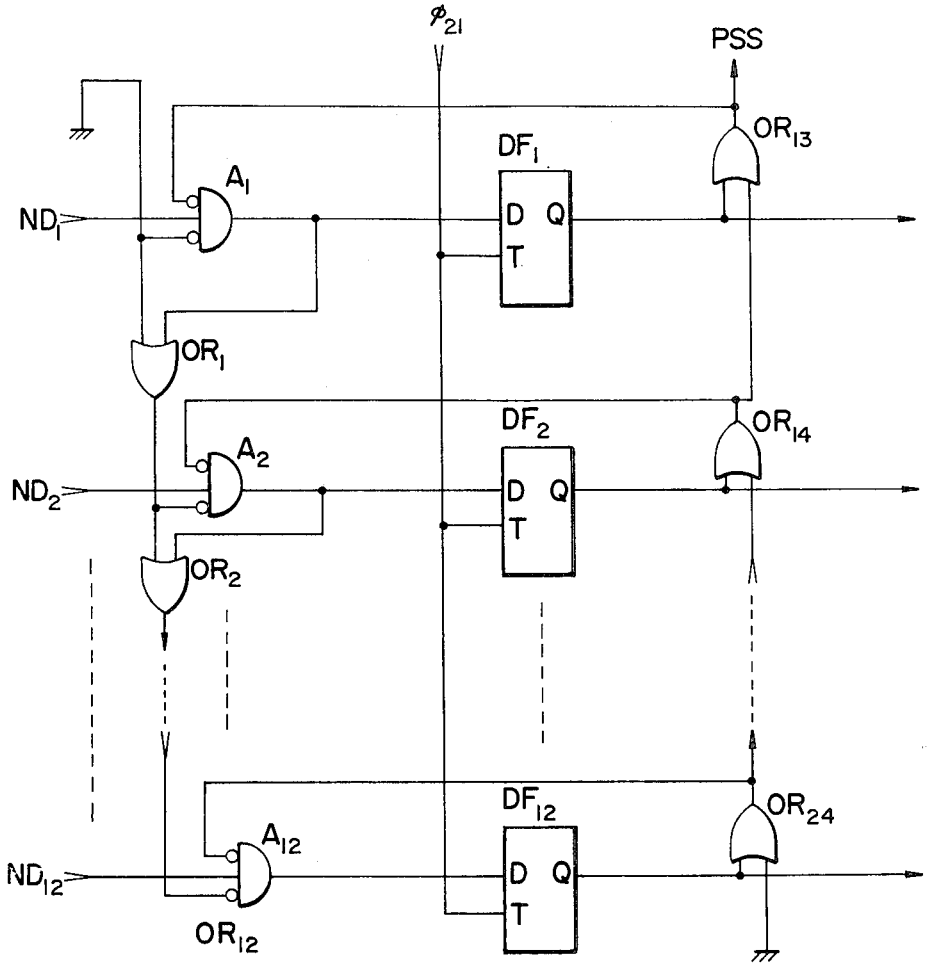

FIG. 6 illustrates in detail an example of the priority selector 2-3 utilized in the key code generator shown in FIG. 4. The input note code data signals $ND_1$ to $ND_{12}$ of the respective blocks, which are outputted from the key switch matrix 1, are respectively supplied to AND gates $A_1$ to $A_{12}$. Assuming that the input signals $ND_1$ and $ND_{12}$ are "1" and that Q outputs from flip-flops $DF_1$ to $DF_{12}$ are "0", OR gates $OR_{13}$ to $OR_{24}$ all provide "0" and their inverted outputs are fed to the AND gates $A_1$ to $A_{12}$, respectively. Then, the input signal $ND_1$ becomes "0" and the AND gate $A_1$ provides "0" and an OR gate $OR_1$ provides "0" and its inverted output "1" is applied to the AND gate $A_2$. The input signal $ND_2$ becomes "1" and the AND circuit $A_2$ applies "1" to an OR gate $OR_2$ and the OR gates $OR_2$ to $OR_{11}$ all provide "1" and their inverted outputs "0" are applied to the AND gates $A_3$ to $A_{12}$, respectively. As a result of this, the input signals $ND_3$ to $ND_{12}$ are inhibited in the AND gates $A_3$ to $A_{12}$ and only the AND gate $A_2$ outputs "1" and the other AND gates output "0", the outputs from the AND gates $A_1$ to $A_{12}$ being applied to the flip-flop $DF_1$ to $DF_{12}$. Next, only the flip-flop $DF_2$ provides "1" due to the clock $\phi_{21}$. This output inhibits gating of the AND gates $A_2$ and $A_1$ via the OR gates $OR_{14}$ and $OR_{13}$, with the result that the OR gates $OR_2$ to $OR_{11}$ provide "0" to open the AND gates $A_3$ to $A_{12}$. Accordingly, the input signal $ND_{12}$ is then applied to the flip-flop $DF_{12}$ via the AND gate $A_{12}$ and only the flip-flop $DF_{12}$ is actuated by the next clock $\phi_{21}$ to output "1". This output applies its inverted output "0" to the AND gates $A_1$ to $A_{12}$ via the OR gates $OR_{24}$ to $OR_{13}$, respectively, inhibiting the input signals $ND_1$ to $ND_{12}$. Consequently, the flip-flops $DF_1$ to $DF_{12}$ provide "0" in reply to the next clock $\phi_{21}$. In the above operation, the output signal PSS from the OR gate $OR_{13}$ is "1" during outputting of the selected signals, and after all the signals are outputted, the signal PSS becomes "0". In this manner, those of the input signals $ND_1$ to $ND_{12}$ which are "1" are selectively outputted one after another in accordance with predetermined priority. The time slot required therefor is only two time slots in the above example. The output signal from the priority selector 2-3 is applied as an address signal to the note code memory 2-4.

Figure 7:
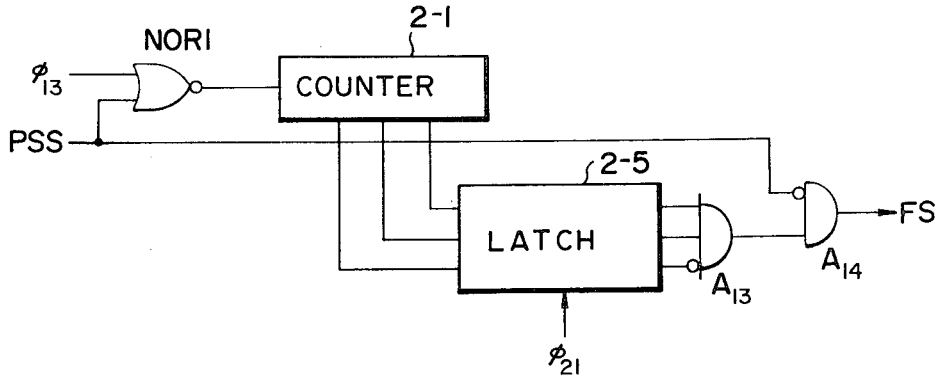

FIG. 7 is a detailed circuit diagram showing an example of the frame detector 2-7 utilized in the key code generator of FIG. 4. When the 3-bit count value of the modulo 6-step counter becomes "110", it is latched in the latch circuit 2-5 to provide "1" from an AND gate $A_{13}$. When the signal PSS becomes "0", an AND gate $A_{14}$ provides "1", which is used as the frame signal FS.

Figure 8:
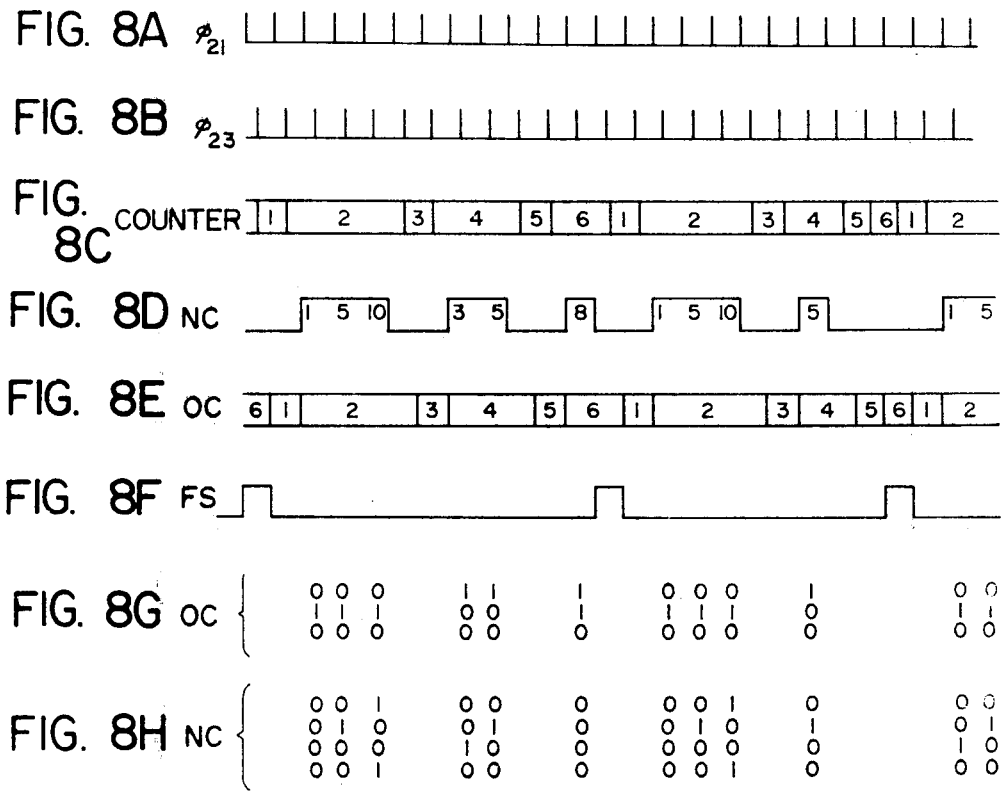
FIGS. 8A to 8H illustrate waveforms for the operation of the example depicted in FIG. 4.

FIG. 8 is a timing chart showing the operation of the key code generator of FIG. 4. Let it be assumed that after six key switches $O_2N_1$, $O_2N_5$, $O_2N_{10}$, $O_4N_3$, $O_4N_5$ and $O_6N_8$ are turned ON, the switches $O_4N_3$ and $O_4N_8$ are turned OFF. The counter 2-1 in FIG. 4 counts the clock $\phi_{23}$ of FIG. 8B. When the count value of the counter 2-1 has reached a second octave of the key switch matrix 1 as shown in FIG. 8C, the priority selector 2-3 detects the note code data signals $ND_1$, $ND_5$ and $ND_{10}$ with the clock $\phi_{21}$ of FIG. 8A to select and output the note code (NC) of FIG. 8D in a sequential order. At this time, the signal PSS becomes "1" and is applied to the NOR gate NOR1 to inhibit the clock $\phi_{23}$ of FIG. 8B which is inputted to the counter 2-1 and, in this while, the counter 2-1 is stopped. The note code (NC) planted in the note code memory 2-4 from the priority selector 2-3 is represented by binary codes of FIG. 8H. The octave code (OC) of FIG. 8E in this case is the code that the output from the counter 2-1 is timed with the clock $\phi_{21}$, and the second octave code becomes a long time slot and is represented by binary codes of FIG. 8G. Upon completion of outputting of the key code data KCD composed of the note code NC and the octave code OC, the signal PSS becomes "1" to apply the clock $\phi_{23}$ to the counter 2-1 again, scanning the next octave block. When one scanning ends in this manner, that is, when the signal PSS becomes "0" in a sixth octave, the frame detector 2-7 provides the frame signal FS of one time slot. With the next frame signal, the two key switches are turned OFF as depicted and the second octave remains unchanged and, in a fourth octave, one key switch remains and, in the sixth octave, no key switch exists. That is, four key switches remains. Accordingly, the time slot of one frame in the case of six key switches being closed is the time slot of $6+6=12$ and, in the case of four key switches being closed, one frame is a time slot of $4+6=10$. Thus, the so-called variable frame system is provided that one period varies with the number of keys being depressed. The key code data KCD composed of the note code NC and the octave code OC in this case is gated by the signal PSS and is outputted only in the time slot in which it is required.

As described above, a plurality of switches having closed contacts are divided into a plurality of octave blocks and the plurality of blocks are sequentially scanned by a first clock and then information of closed key switches of each block is selectively outputted by a second clock sequentially in accordance with predetermined priority and while the priority selection signal PSS exists, the first clock is inhibited to temporarily stop the block scanning. The frame signal pulse is composed of one time slot and a variable frame is provided that one frame time is the time slot determined by the number of blocks and the number of closed key switches. In the prior art, one clock and a ring counter are used as the means for temporarily stopping the block scanning, whereas in the present invention this means is simple-structure using two clocks supplied from the latter stage of the electronic musical instrument, a counter and a latch circuit and they are synchronized with the latter stage of the instrument. At any rate, the time necessary for one scanning can be made for shorter then the time for scanning all key switches in the cases of the conventional TDM and PCM systems. Further, the amount of wiring can be decreased, so that the electronic musical instrument of this invention gets around the problem of the number of pins in the semiconductor integrated circuit, and hence can be easily integrated.

Figure 9:
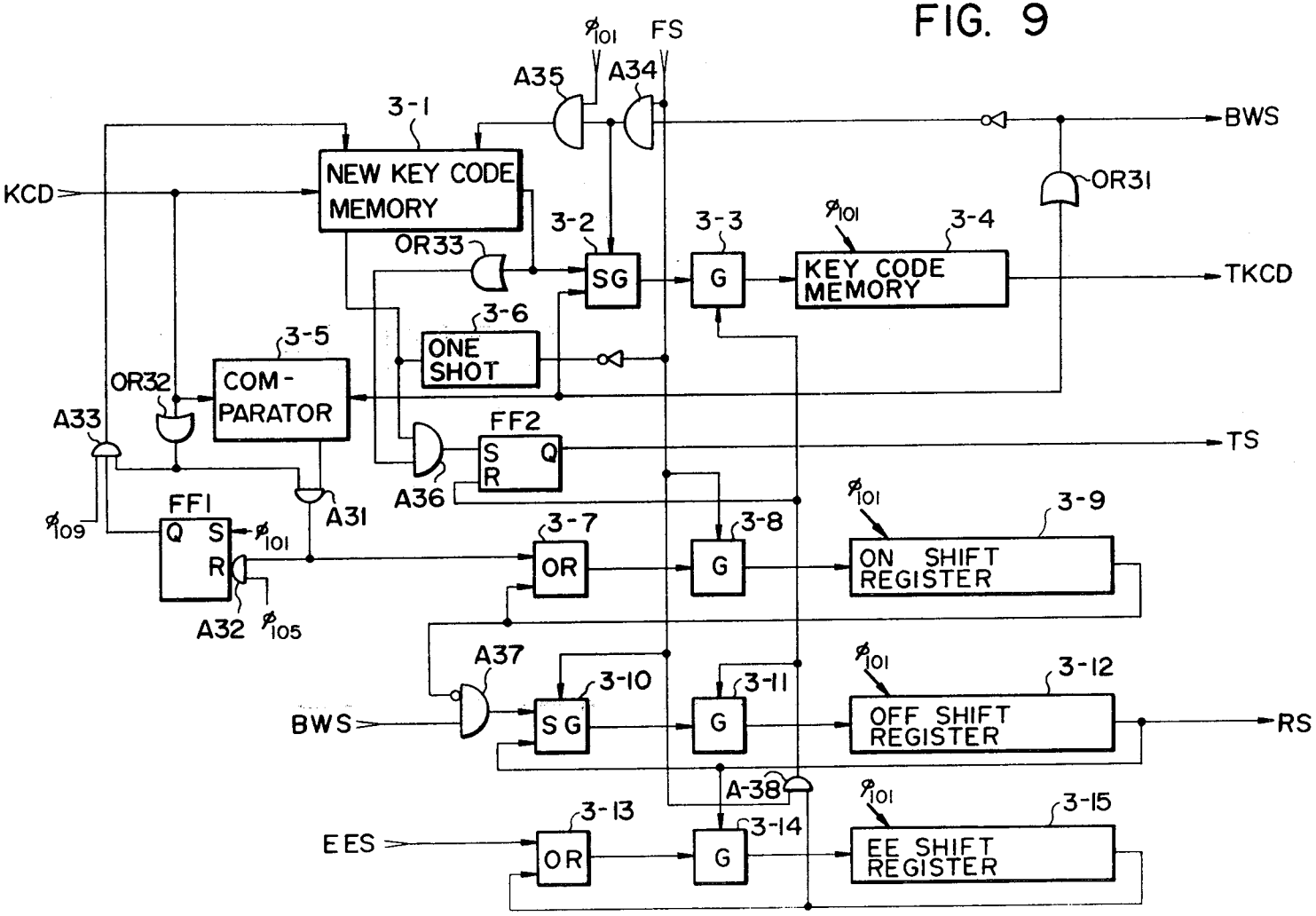
FIG. 9 is a detailed block diagram showing an example of a key code data assignor 3 employed in the embodiment of FIG. 1.

FIG. 9 is a block diagram showing in detail an example of the key code data assignor 3 employed in FIG. 1. In FIG. 9, in reply to the key code data KCD (NC of FIG. 8D and OC of FIG. 8E) and the frame signal FS (FS of FIG. 8F) which is sent out of the key code generator of FIG. 4 at the timings $\phi_{21}$ and $\phi_{23}$ described in FIG. 2 and in FIGS. 8A and 8B, the key code data assignor 3 operates at a speed eight times the key code data KCD and the frame signal FS. Each channel is divided into eight time-divided time slots. The key code data assignor 3 provides the time-divided key code data TKCD, the content presence or absence signal BWS, the release signal RS and the high-speed release signal FRS. The output signals vary in the time slot of the frame signal FS. The key code data from the key code generator 2 is applied to a new key code memory 3-1 and a comparator 3-5. A key code memory 3-4 operates at a speed eight times to provide the time-divided key code data TKCD in reply to the clock $\phi_{101}$ of FIG. 2, which data is applied to the comparator 3-5. An SR flip-flop FF1 is set by the clock $\phi_{101}$. Next, when the key code data KCD and the time-divided key code data TKCD match with each other, the comparator 3-5 provides "1", by which a flip-flop FF1 is reset via AND gates A31 and A32 at the timing of the clock $\phi_{101}$. Where the key code data KCD and the time-divided key code data TKCD do not match with each other, that is, when a new key code data KCD is applied, since the Q output which is applied from the flip-flop FF1 to an AND gate A33 a the timing of the clock $\phi_{109}$ is "1", the new key code data is written by the output from the AND gate A33 via an OR gate OR32 in the new key code memory 3-1 formed with an F1F0 memory. The new key code memory 3-1 can also be formed easily with a right-left shift register or a read-write memory RAM. The output from the OR gate OR32 is applied to the AND gates A32 and A33 so that the abovesaid operation takes place only upon application of the output from the OR gate OR32, that is, the key code data KCD. Thus, the new key code data KCD are detected and sequentially written in the new key code memory 3-1 for temporary storage. Upon completion of outputting of the key code data KCD of one period, the frame signal FS becomes "1" to start writing of the new key code data. An OR gate OR31 detects the presence or absence of the key code data to provide the content presence or absence signal BWS. Its inverted output $\overline{BWS}$ by inverter, that is, a signal indicative an empty channel, is applied to an AND gate A34. When the frame signal FS is "1", a select gate (SG)3-2 selects the output from the new key code memory 3-1 and provides the selected output to the key code memory 3-4 via a gate (G)3-3. The output from the AND gate A34 is applied to an AND gate A35 to read out the new key code memory 3-1 at the timing of the clock $\phi_{101}$, by which the key code data KCD stored in the new key code memory 3-1 are sequentially written in empty channels of the key code memory 3-4 when the frame signal FS is "1". The output from the comparator 3-5 is also supplied via the AND gate A31 to an OR gate (OR)3-7 and is further written via a gate (G)3-8 in an ON shift register 3-9 and its inverted output is applied to an AND gate A37. Also, the content presence or absence signal BWS is supplied to the AND gate A37 to detect turning OFF of the key switch. When the frame signal FS is "1", the output from the AND gate A37 is selected by a select gate (SG)3-10 and is written via a gate (G)3-11 in an OFF shift register 3-12. The output from the OFF shift register 3-12 is used as the release signal RS. Next, the envelope end signal ESS sent out of the envelope generator 4 of FIG. 1 is inputted to a gate (G)3-14 via an OR gate (OR)3-13. The gate (G)3-14 is open and closed when the output signal RS from the OFF shift register 3-12 is "1" and "0", respectively.

Accordingly, when the signal RS is provided, the signal ESS is written in an EE shift register 3-15. The output from the EE shift register 3-15 is applied to an AND gate A38 together with the frame signal FS. The output from the AND gate A38 is supplied to gates (G)3-11 and (G)3-3 and a flip-flop FF2 when the frame signal FS is "1". Thus, "0" is written in each channel to reset it.

Next, when key switches more than empty channels are closed, some of the new key code data KCD are not read out of the new key code memory 3-1 and remain therein in some cases. In such a case of an overflow, an OR gate OR33 connected to the output of the new key code memory 3-1 provides "1" and an inverted signal $\overline{FS}$ of the frame signal from an inverter sets the flip-flop FF2 via a one-shot multivibrator 3-6 and an AND gate A36, outputting an overflow signal TS. With this signal TS, an operation of overflow processing is started.

As described above, in the key code assignor 3, the key code of the variable frame from the key code generator is stored in a keycode memory of any one of the channels of the same number as the number of sounds simultaneously produced, and the time-divided key code is outputted at a clock speed higher than the number of channels. The key code sent out of the key code generator and the time-divided key code are compared with each other to detect the key code of a newly closed key switch and the key code is temporarily stored in the new key code memory. Then, empty channels of the key code memory are each detected by the channel content presence or absence signal of the key code memory and, at the time of the frame signal, the key code stored in the new key code memory is transferred to each channel of the key code memory. Further, that of the channels of the key code memory which is keyed OFF is detected and this keyed OFF state is temporarily stored in the OFF memory and an envelope release signal is provided. Thus, the key code data of an asynchronous variable frame from the key code generator are converted to time-divided key codes corresponding to a plurality of channels and synchronized with a plurality of clocks of the latter stage of the electronic musical instrument. Moreover, the processing of detecting the keyed OFF state to output the envelope release signal can be realized by a simple structure in relation to the abovesaid function.

Figure 10:
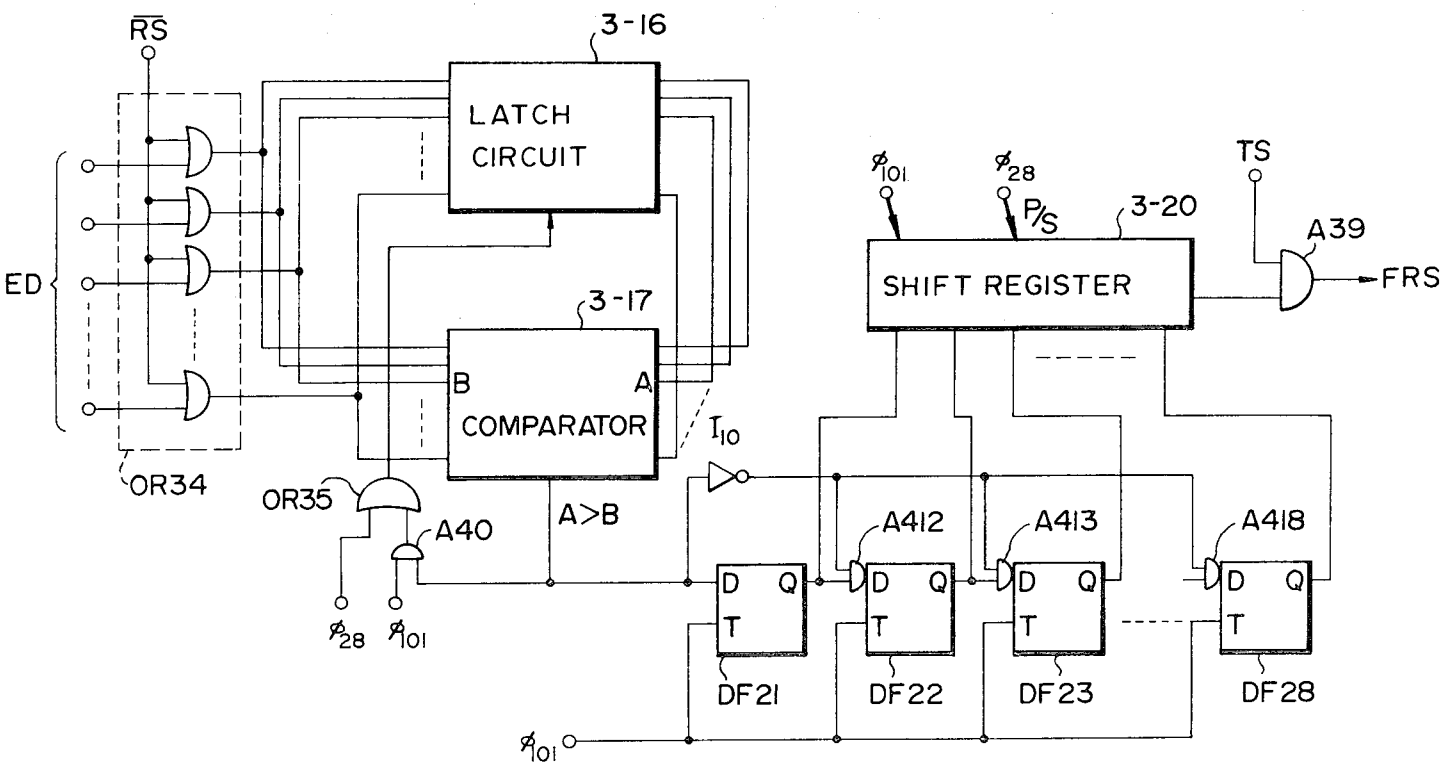
FIG. 10 is a detailed block diagram showing an example of an overflow control circuit.

FIG. 10 is a block diagram showing an example of the overflow control circuit for use in this invention. In FIG. 10, an envelope data ED is applied as a time-divided signal from the envelope generator 4 of FIG. 1 to an OR gate OR 34 together with an inverted signal $\overline{RS}$ of the release signal. In the absence of the release signal RS, "1" is applied to a latch circuit 3-16 and a comparator 3-17 and, in the presence of the release signal RS, the envelope data ED is applied to them. The latch circuit 3-16 writes therein an eighth time-divided channel data via an OR gate OR35 in reply to the timing clock $\phi_{28}$. The output from the latch circuit 3-16 is applied to the comparator 3-17. Letting the next data and the output from the latch circuit 3-16 be represented by B and A, respectively, when A>B, the comparator 3-17 provides "1" to write "1" in a flip-flop DF21 forming a shift register. Further, the output from the comparator is supplied to an AND gate A40 to apply the clock $\phi_{101}$ to the latch 3-16, rewriting its stored data from A to B. In this manner, smaller envelope data ED are written in the latch circuit 3-16 one after another and sequentially compared in all the channels. On the other hand, the output from the comparator 3-17 is applied to an inverter $I_{10}$ and its inverted output is applied to AND gates A412 to A418. When the comparator 3-17 provides "1", "0" is written by the AND gates A412 to A418 in flip-flops DF22 to DF28 and "1" is written only in a flip-flop DF21. The compared data are sequentially shifted by the clock $\phi_{101}$ to give priority to the compared data which are newly outputted. The outputs from the flip-flops DF21 to DF28 are applied to a parallel inserial out shift register 3-20. At the time of the timing clock $\phi_{23}$, the outputs from the flip-flops DF21 to DF28 are applied by the clock $\phi_{101}$ in parallel to the shift register 3-20, and are serially outputted therefrom by the clock $\phi_{101}$. In the case of the channel of the minimum level of the release, the output from the shift register 3-20 is "1" and when the overflow signal TS occurs, the shift register 3-20 provides the high-speed release signal FRS via an AND gate A39 to start a high-speed envelope release. This compulsorily terminates the envelope to provide empty channels, by which the key code data currently stored are rapidly rewritten to the new key code data being overflown.

As set forth above, time-divided envelope data of a desired channel from the envelope generator is inputed in parallel to the comparison level memory and the comparator. The envelope data is stored as the comparison level data A in the comparison level memory A and is compared with the next comparison level data B in the comparator. When A>B, the level data B is stored in the level memory. This operation is repeated, by which a signal of the minimum level provided from the comparator at the end of one cycle of detection of all channels is selected and outputted in a time divisional manner to detect the envelope data of the channel of the minimum level and the high-speed release signal is applied to the envelope generator in accordance with an overflow signal from the key code data assignor. Thus, it is possible to release capture of the envelope of the minimum level and to capture a new envelope in place of the former.

Thus, the overflow control circuit set forth above is suitable for use with the key code assignor for generating a time-divided key code and the envelope generator controlled thereby, and can be much simplified in structure as compared with overflow circuits heretofore employed for the same purpose as described above.

Figure 11:
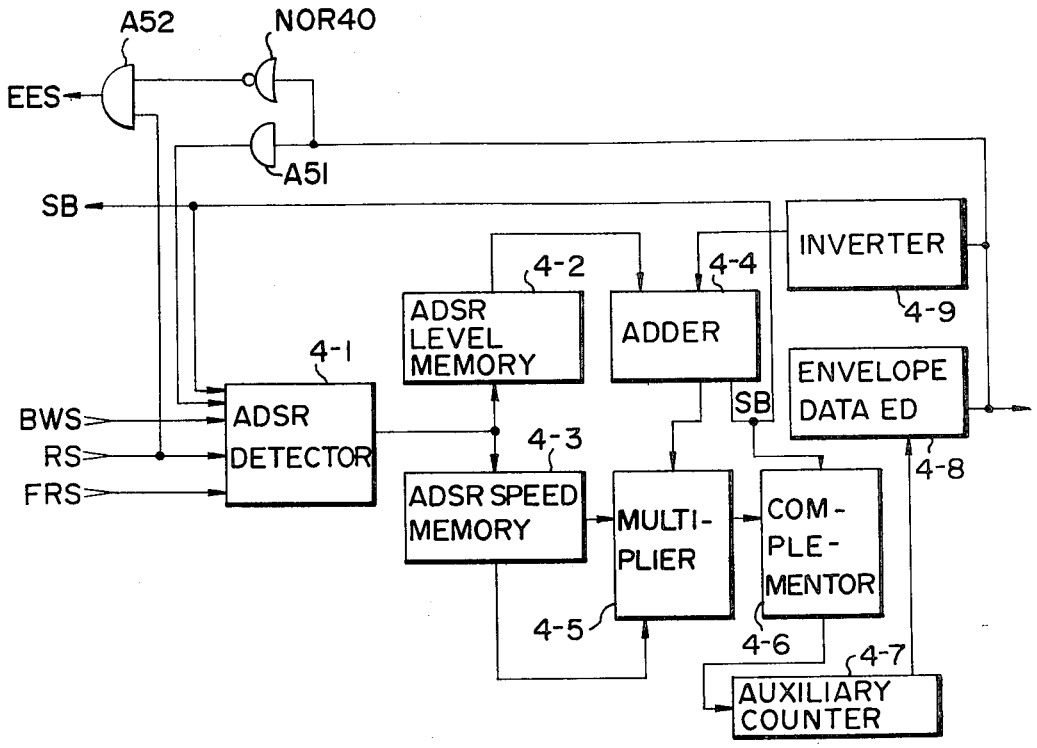
FIG. 11 is a detailed block diagram showing an example of an envelope generator 4 utilized in the embodiment of FIG. 1.

FIG. 11 illustrates an example of the envelope generator 4 used in the embodiment of this invention depicted in FIG. 1. This circuit forms a cyclic digital filter which is expressed by the following difference equation:

$$Y_n=(1/k)(Y_{n-1}-X_{n-1})+X_{n-1}$$

where $X_n$ is an input signal, $Y_n$ is an output signal and k is a constant. The input signal $X_n$ is determined by the output from an ADSR (Attack, Decay, Sustain, Release) level memory 4-2. The constant k is determined by the output from an ADSR speed memory 4-3. That is, an ADSR detector 4-1 is supplied with the control signal, the content presence or absence signal BWS, the release signal RS and the high-speed release signal FRS from the key code data assignor of FIG. 9 and the overflow control circuit FRS, a sign SB of the output from an adder 4-4 described later and the immediately preceding output of the envelope data via an AND gate A51. These control signals control addresses of the ADSR level memory 4-2 and the ADSR speed memory 4-3. The output from the ADSR level memory 4-2 is applied to the adder 4-4. An auxiliary counter 4-7 and a main counter 4-8 make up an accumulator with a shift register of eight channels and an adder. The envelope data of the immediately preceding count of the main counter 4-8 is provided via an inverter 4-9 to the adder 4-4 to derive therefrom data $Y_{n-1}-X_{n-1}$. At this time, the output is provided in the form of an absolute value $|Y_{n-1}-X_{n-1}|$ for input to a multiplier 4-5. The sign bit SB is applied to a complementer 4-6. That is, the multiplier 4-5 provides an output $k|Y_{n-1}-X_{n-1}|$ multiplied by the ADSR speed coefficient to derive $K(Y_{n-1}-X_{n-1})$ from the complementer 4-6. The output from the complementer 4-6 is applied to the auxiliary counter 4-7 to provide $(1/K)(Y_{n-1}-X_{n-1})+X_{n-1}$ in cooperation with the main counter 4-8. At this time, the output from the complementer 4-7 is neglected and the output from the main counter 4-8 is obtained as the envelope data. The signal SB is "1" when the envelope decays. When envelope signals are all "1" that the envelope has the maximum level, the AND gate A51 provides "1". When the envelope signals are all "0", a NOR gate NOR40 provides "1", which is applied to an AND gate A52 together with the release signal RS to provide the envelope end signal ESS for input to the key code data assignor of FIG. 4.

Figure 12:
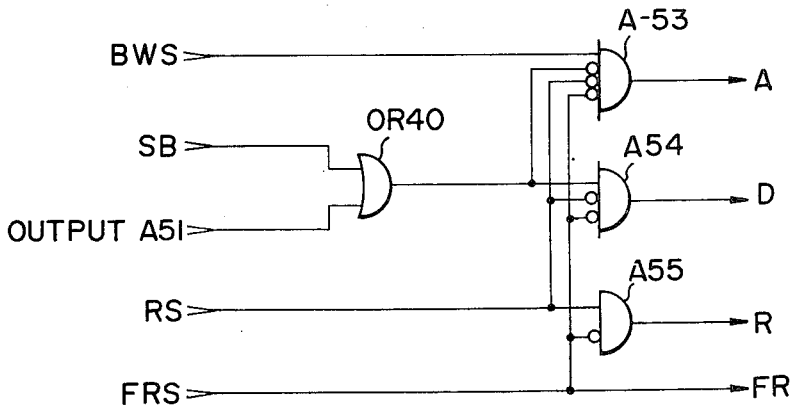
FIG. 12 is a detailed circuit diagram showing an example of an ADSR detector 4-1 used in the example depicted in FIG. 11.

FIG. 12 is a detailed circuit diagram showing an example of the ADSR detector 4-1 used in FIG. 11. In the ADSR detector 4-1, the content presence or absence signal (BWS) and the release signal (RS) from the key code data assignor of FIG. 9 are respectively applied to AND gates A53 and A55 to provide therefrom attack (A) and release (R) control signals for memory readout. The signal SB from the adder 4-4 of FIG. 11 and the output from the main counter 4-8 through the AND gate A51 are applied via an OR gate OR40 to an AND gate A54 to provide therefrom a decay (D) control signal for memory readout. The high-speed release signal (FRS) from the overflow control circuit of FIG. 10 is used as a high-speed release (FR) control signal for memory readout. The inputs to the AND gate A53 except the signal BWS, that is, the output from the OR gate OR40 and the signals RS and FRS, are inverted signals. The inputs to the AND A54 except the output from the OR gate OR40, that is, the signals RS and FRS, are similarly inverted signals. One input FRS to the AND gate A55 is also an inverted signal.

In accordance with such conditions, addresses of the ADSR level memory 4-2 and the ADSR speed memory 4-3 are read out to set therein predetermined values.

Figure 13A:
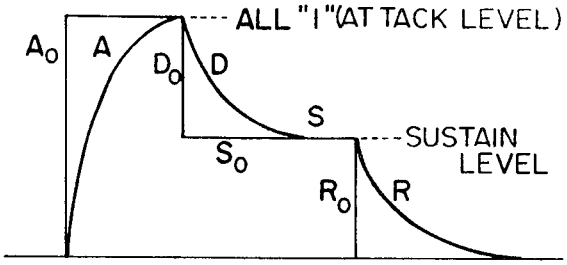
FIGS. 13A to 13C are graphs respectively showing envelope waveshapes provided by the envelope generator of FIG. 11.
Figure 13B:
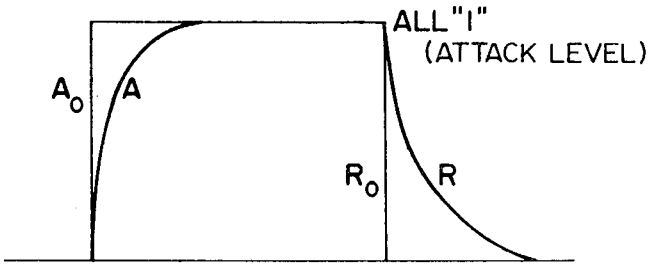
Figure 13C:
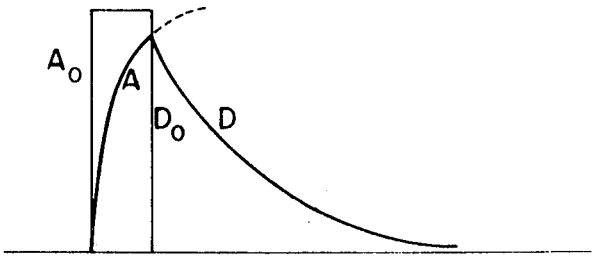

FIGS. 13A to 13C show examples of envelope waveshapes generated by the envelope generator depicted in FIG. 11. FIG. 13A shows an ADSR waveshape which attacks (A) up to its maximum, i.e. the all "1" state, at a predetermined speed and decays (D) at a predetermined speed and is then released (R) at the sustain level (S). FIG. 13B shows an AR waveshape which attacks (A) up to its maximum value, i.e. the all "1" state, at a predetermined speed and is then released (R) after a predetermined period of time. FIG. 13C shows an AD waveshape which shifts to the decay (D) at a set level before the attack (A) of a predetermined speed reaches its maximum value, and is decayed at a predetermined speed. In this manner, a variety of envelopes can be easily generated by reading out the addresses of the attack, decay, sustain and release and setting predetermined levels and speeds. That is, based on a square waveshape combination composed of input signals $A_0$, $D_0$, $S_0$ and $R_0$, an envelope waveshape composed of curves are formed to provide the so-called filter characteristic.

As described above, the envelope generator employs a cyclic digital filter and has an envelope level memory for sequentially controlling the waveshape levels of the attack, decay, sustain and release of an envelope waveshape and an envelope speed memory for storing filter constants to sequentially controlling the envelope speed in accordance with the attack, decay, sustain and release of the envelope waveshape. By controlling the transfer characteristic of the cyclic digital filter with the output data from these memories, a required envelope waveshape can be generated. Thus, the envelope waveshape generating system according to this invention abounds in diversity, as compared with a conventional analog envelope waveshape generating system, and uses a smaller memory capacity than in a digital envelope waveshape generating system and is simple in circuit structure and easy to control.

Figure 14:
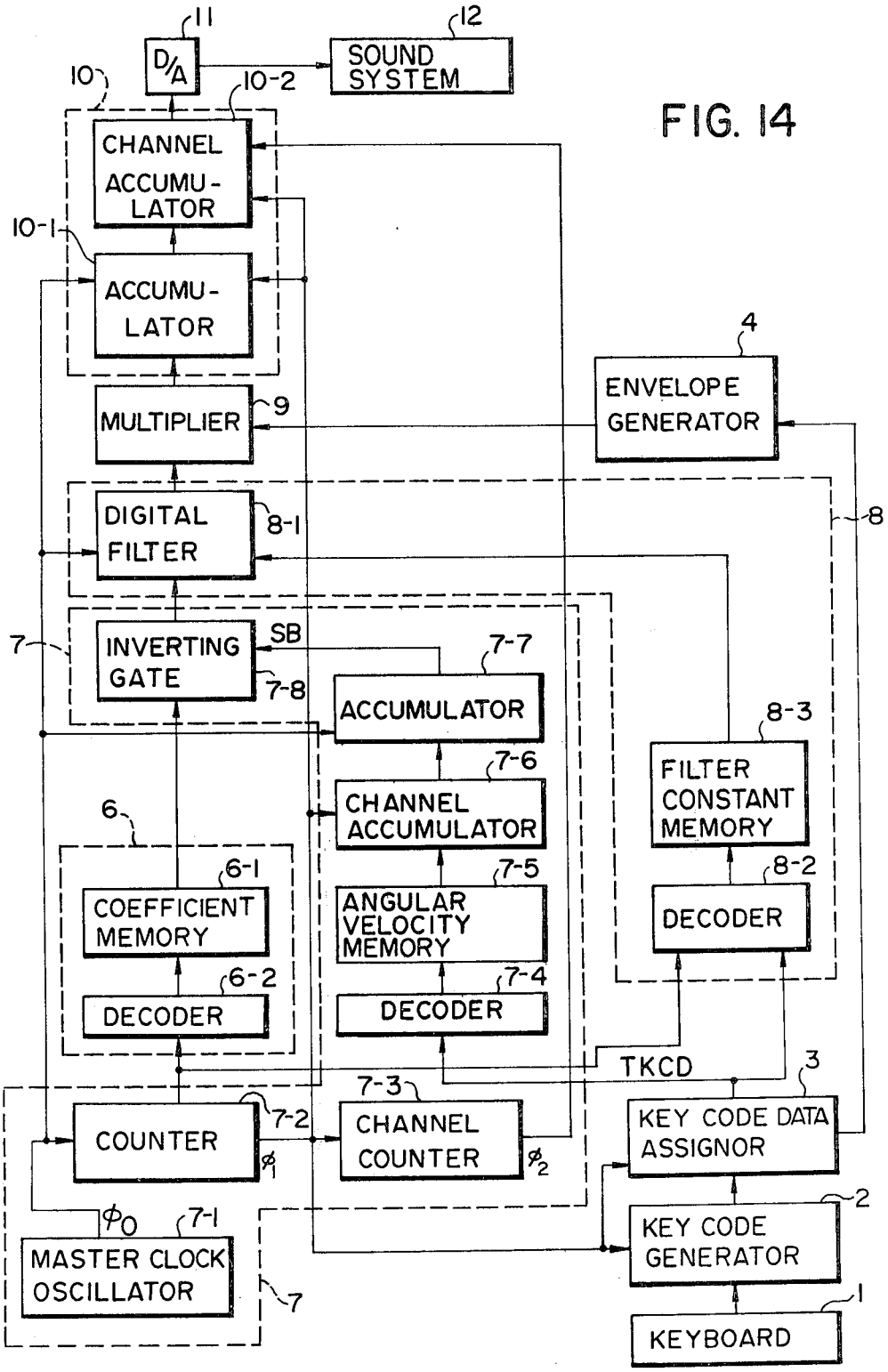
FIG. 14 is a block diagram illustrating in detail an example of a square wave generator 7 employed in the embodiment of FIG. 1.

FIG. 14 is a detailed circuit diagram illustrating the square wave generator 7 and associated circuits in FIG. 1. In FIG. 14, the square wave generator 7 is indicated by blocks 7-1 to 7-8 in a broken-line block and the associated circuits are also shown to be composed of blocks in broken-line blocks, respectively. The parts corresponding to those in FIG. 1 are identified by the same reference numerals.

A master clock oscillator 7-1 of the square wave generator 7 generates the clock pulse of 2.4 MHz indicated by $\phi_1$ in FIG. 2, which pulse $\phi_1$ is applied to a decimal degree counter 7-2. The output from the counter 7-2 is provided via a decoder 6-2 of the square wave memory 6 to a coefficient memory 6-2 designated by the tablet draw bar switch 5 to read out the memory. On the other hand, a key code of a variable frame, generated from the key code generator 2 in response to the key depression on the keyboard 1, is applied to the key code data assignor 3 and the time-divided key code data TKCD is read out therefrom by the clock $\phi_{10}$ of the period ten times the clock $\phi_0$ shown in FIG. 2 and is provided via a decoder 7-4 to an angular velocity memory 7-5 to read out therefrom an angular velocity $\omega$. In the angular velocity memory 7-5 there is stored in the form of a binary code the angular velocity $\omega$ for determining one period. In the present example, if a sampling frequency is 30 KHz, the angular velocity $\omega$ is expressed by the equation $\omega=2\pi f/30\times10^3$. The angular velocity $\omega$ thus read out is accumulated by the clock $\phi_1$ in a channel accumulator 7-6 for each channel, providing an output $\omega T$. The outpt $\omega T$ is accumulated by the clock $\phi_0$ in a degree accumulator 7-7 to provide $n\omega T$. The accumulator 7-6 and 7-7 are set so that their maximum accumulated numbers may be $2\pi$, and a number larger than $2\pi$ is neglected. When the output $n\omega T$ from the accumulator 7-7 is $i\pi$ to $2i\pi$ ($i=1, 2, \ldots$), "1" is provided and, in the other cases, "0" is provided. That is, square waves SQU(1) to SQU(10) are generated which have the periods 1 to 10 times the fundamental wave, respectively. The output from the accumulator 7-7 is applied to an inverting gate 7-8. The inverting gate 7-8 is supplied with coefficient values $A_1$ to $A_{10}$ read out of the coefficient memory 6-1 and corresponding to the square waves SQU(1) to SQU(10), respectively. The coefficient values are inverted by the inverting gate 7-8 to provide $A_1$SQU(1) to to $A_{10}$SQU(10). The output from the gate 7-8 is applied to a digital filter 8-1 of the digital filter 8. The output from the counter 7-2 and the time-divided key code data TKCD from the key code data assignor 3 are both applied to a decoder 8-2 of the digital filter 8 to read out filter constant memory 8-3. The output from the filter constant memory 8-3 is provided to the digital filter 8-1. The filter constants stored in the memory 8-3 are to achieve filtering which differs for each degree N and each scale. The digital filter 8-1 provides filtered square waves $f_1[A_1SQU(1)]$ to $f_{10}[A_{10}SQU(10)]$. In the case of a high-pitched tone such as $C_7$ or the like, the square wave SQU(10) has a frequency of about 40 KHz, which does not satisfy the sampling theorem. Accordingly, for suppressing the high frequency range, such a square wave is filtered to a maximum to provide an output L dB.

The output from the digital filter 8-1 is applied to the multiplier 9 in which it is multiplied by the envelope data provided from the envelope data generator 4. The multiplied output is accumulated by the clock $\phi_0$ in a degree accumulator 10-1 of the accumulator 10. The output from the accumulator 10 is accumulated by the clock $\phi_1$ in a channel accumulator 10-2. The output from the channel accumulator 10-2 is applied to the D-A converter 11 and is then fed to the sound system 12 to produce the selected musical note. The degree accumulator 10-1 is cleared by the clock $\phi_1$ every period and the channel accumulator is cleared by the output clock $\phi_2$ from a channel counter 7-3, shown in FIG. 2.

Figure 15:
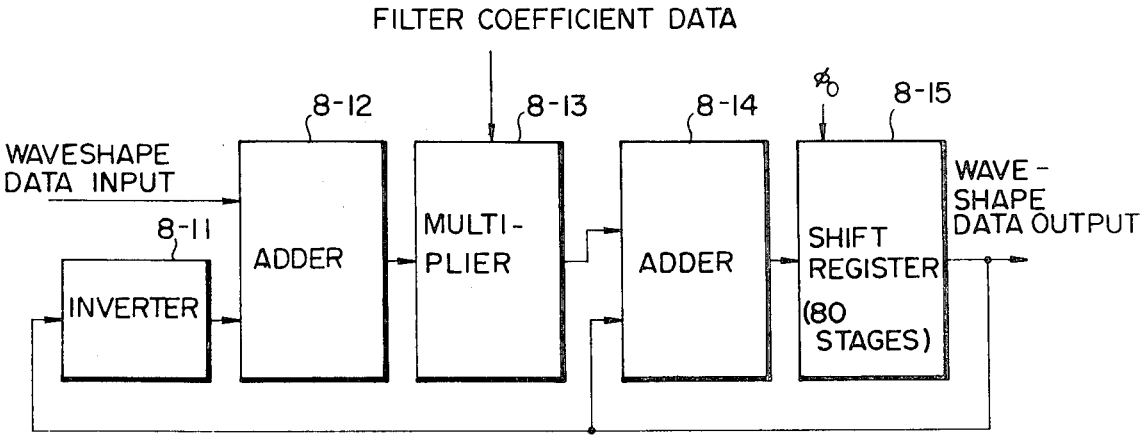
FIG. 15 is a block diagram showing in detail an example of a digital filter 8-1 utilized in the example depicted in FIG. 14.

FIG. 15 is a detailed circuit diagram showing an example of the digital filter 8-1 used in FIG. 14. The digital filter 8-1 is a cyclic digital filter which has the structure that the output signal $Y_{n-1}$ is expressed by the difference equation $Y_{n-1}=(Y_n-X_n)(1/k)$, where $X_n$ is the input signal. The waveshape data $A_1SQU(1)$ to $A_{10}SQU(10)$ outputted from the inverting gate 7-8 of the square wave generator 7 in FIG. 14 are applied to an adder 8-12. The output from the adder 8-12 is provided to a multiplier 8-13 and is multiplied by the filter constant sent out in synchronism with the waveshape data, thereafter being applied to an adder 8-14. The output from the adder 8-14 is applied to a 80-stage shift register 8-15 which operates on the clock $\phi_1$. The output from the shift register 8-15 is fed back to the adder 8-14 and an inverter 8-11. The adder 8-14 and the shift register 8-15 constitute an accumulator and a delay circuit, providing from the shift register 8-15 waveshape data $Y_{n-1}$ that $Y_{n-1}=(Y_n-X_n)(1/k)+Y_n$. It is also possible to obtain a sharp filter characteristic by several serially-connected stages of such shift registers.

Figure 16:
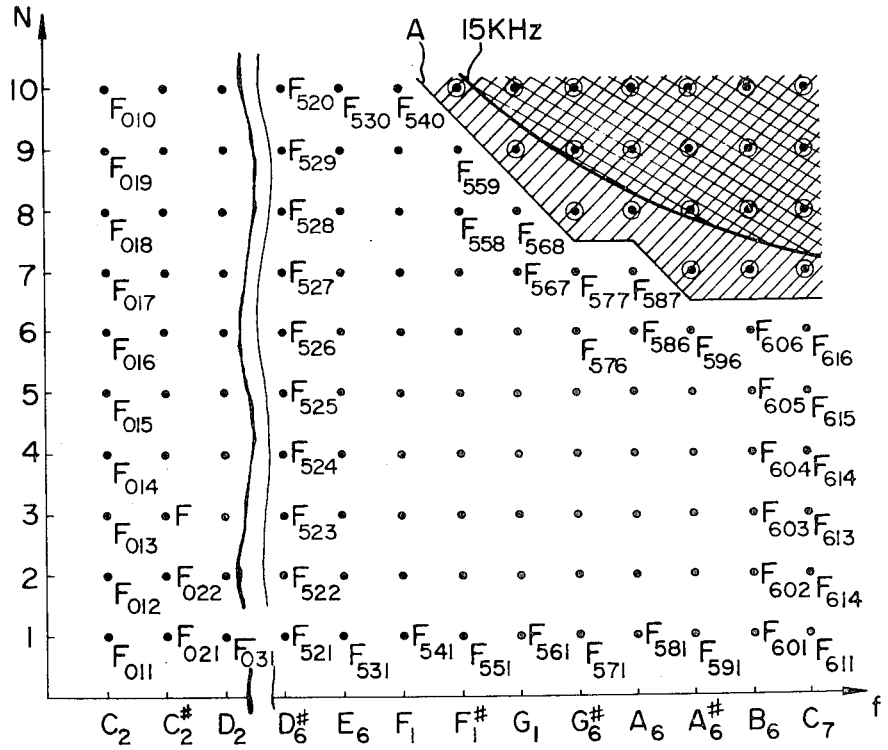
FIG. 16 is a graph explanatory of means for selecting a time constant for the supression of a high order square wave.

FIG. 16 is graph explanatory of filter constant selecting means for the high-degree square wave suppression. The filter constant $F_{fN}=/k$ is selected based on the scale frequency f and the degree N of the square wave. If the waveshape sampling frequency is 30 KHz, only waveshapes below 15 KHz are filtered due to the sampling theorem and, for the higher frequencies, the sampling theorem is not satisfied and an appropriate filtering cannot be exhibited. Also at the stage of square wave generation, the frequencies above 15 KHz cannot be produced and square waves of faulty frequencies are generated. To avoid this, it is necessary to suppress high-degree square waves in the high frequency range. Accordingly, use is made of means for reducing to "0" thhe filter constant of the hatched region upper than the line A in FIG. 16 which includes a region upper than a line of 15 KHz, i.e. a region in which $f \times N \geqq 15$ KHz, and a region lower than the abovesaid region by one degree in anticipation of an error. The high-degree square waves in the high frequency range can be suppressed by completely filtering the hatched region with the use of the abovesaid means.

Next, an envelope adding system of this invention will be described. As shown in FIG. 14, the square waves of 1 to N degrees from the cyclic digital filter 8-1 is applied to the multiplier 9. On the other hand, an envelope control signal is applied from the key code data assignor 3 to the envelope generator 4 and its output is fed to the multiplier 9 in which the square waves of 1 to N degrees are each multiplied by the abovesaid output to provide square waves added with the envelopes of 1 to N degrees, respectively.

Figure 17:
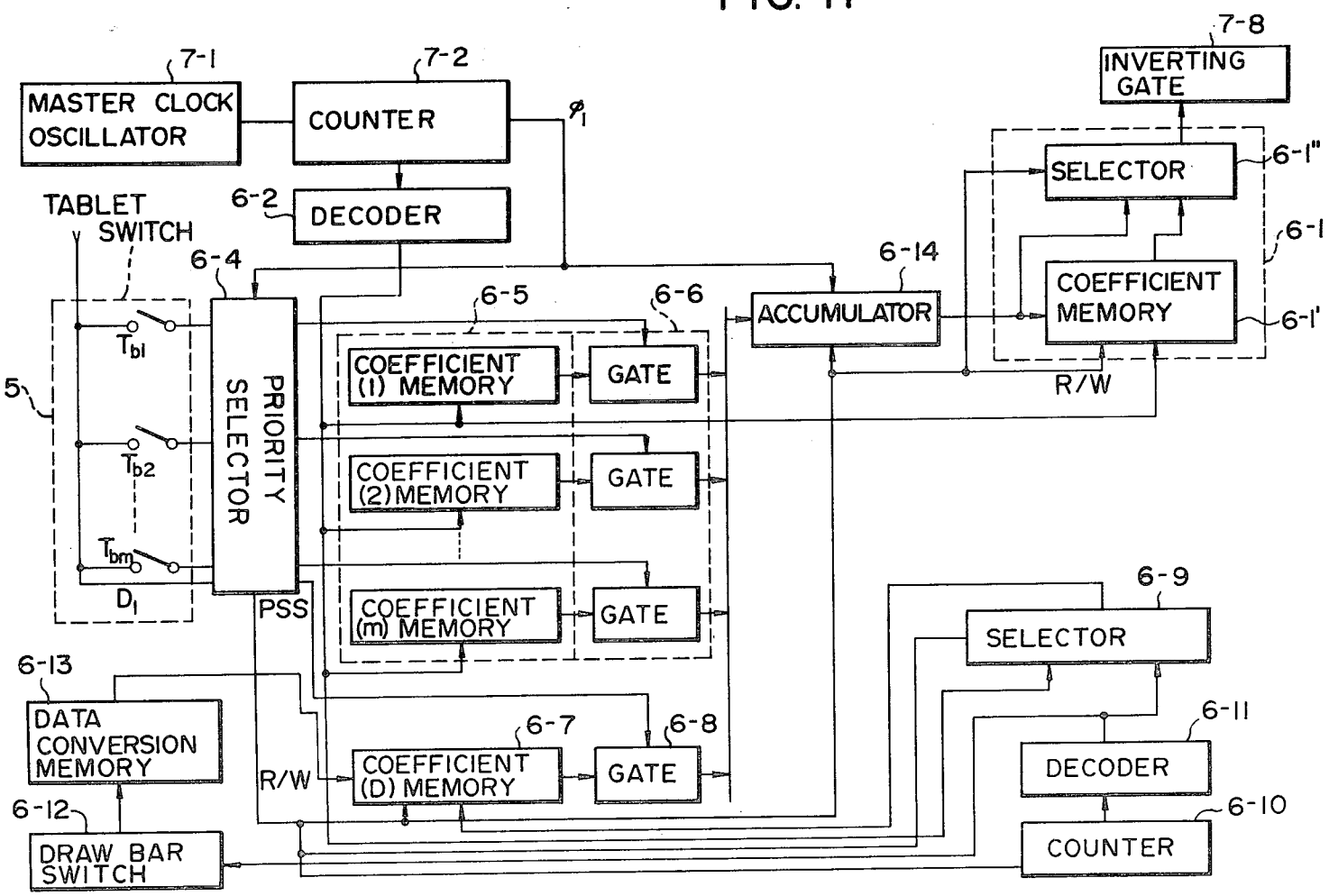
FIG. 17 is a block diagram illustrating in detail examples of a tablet draw bar switch 5 and a square wave level memory 6 employed in the embodiment of FIG. 1.

FIG. 17 illustrates in detail examples of the tablet draw bar switch 5 and the square wave level memory 6 utilized in the embodiment of FIG. 1. Tablet switches $T_{bl}$ to $T_{bm}$ of the tablet draw bar switch 5 are connected to a priority selector 6-4 and a draw bar switch input line $D_1$ is always connected to a high level "1". The priority selector 6-4 is actuated by the clock $\phi_1$ to open gates one after another in accordance with priority, by which coefficient (1) to (m) memories 6-5 are sequentially read out and the coefficient values are accumulated in an accumulator 6-14. On the other hand, a decimal counter 6-10 is actuated by a signal PSS from the priority selector 6-4, the output from which is applied via a decoder 6-11 to a draw bar switch 6-12 to scan it. The output from the draw bar switch 6-12 is written in a coefficient (D) memory 6-7 through a data conversion memory 6-13. This operation is achieved when the signal PSS is "1". Then, when the line $D_1$ is selected in the priority selector 6-4, the output $\phi_1$ from a degree counter 7-2 is applied to a decoder 6-2 and the decoded output is applied via a selector 6-9 to the coefficient (D) memory 6-7 to sequentially read it out and the output is provided to the accumulator 6-14. That is, the data of the draw bar switch 6-12 are all sent out when the signal PSS becomes the high level ten time. The output from the accumulator 6-14 is provided via a selector 6-1'' in synchronism with a coefficient (M) memory 6-1' when the signal PSS is "1". When the signal PSS is "0", the output from the coefficient (M) memory 6-1' is provided via the selector 6-1''. The broken-line block 6-1 composed of the coefficient (M) memory 6-1' and the selector 6-1'' corresponds to the coefficient memory identified by the same reference numeral 6-1 in FIG. 14. The output from this block is applied to an inverting gate 7-8. The inverting gate 7-8 achieves coefficient weighting by the tablet and the draw bar corresponding to the time-divided outputs of square waves of up to N-times frequencies, as described previously in respect to FIG. 14.

As described above, in the above example, upon reception of tablet switch closure information, selected outputs are sequentially provided by predetermined clocks from a priority selector in accordance with predetermined priority and, based on the outputs, the contents of a square wave level memory corresponding to closed tablet switches are sequentially read out by predetermined clocks and the read out data are accumulated. After the contents of the square wave level memory are all read out, the accumulated data are transferred to a main square wave level memory of a square wave generator. Since only the square wave level corresponding to the tablet switch closure information is read out by the function of a square wave level memory unit including the priority selector and the square wave level memory, the readout time can be shortened and the circuit construction can be simplified.

It will be apparent that many modifications and variations may be effected without departing from the scope of the novel concepts of this invention.

What is claimed is:

1. An electronic musical instrument comprising an envelope generator which is composed of a cyclic digital filter whose transfer characteristic changes with the amount of feedback thereto, an envelope level memory for storing its input level to control the waveshape level in accordance with the attack, decay, sustain and release of an envelope waveshape and an envelope speed memory for storing the filter constant of the digital filter to control the envelope speed in accordance with the attack, decay, sustain and release of the envelope waveshape, wherein the transfer characteristic of the cyclic digital filter is controlled by changing the amount of feedback thereto with the output data of the envelope speed memory to generate a required envelope waveshape.

2. An electronic musical instrument according to claim 1 wherein, the cyclic digital filter has the structure that, letting its input and output signals be represented by $X_n$ and $Y_n$, respectively, the cyclic digital filter comprises means for subtracting an input signal $X_{n-1}$ from an output signal $Y_{n-1}$, means for multiplying the subtracting means output by a filter constant determining the transfer characteristic and means for adding input data to the multiplying means output, and wherein the output from the adding means is temporarily stored to provide the output signal $Y_n$ after a certain period of time for input to the subtracting means, thereby to obtain the output signal $Y_n$ expressed by the difference equation, $$Y_n=(1/k)(Y_{n-1}-X_{n-1})+X_{n-1}.$$

3. An electronic musical instrument comprising a square wave generator which is composed of a memory for storing angular velocity information in the form of a binary code corresponding to each time-divided key code sent out of a key code data assignor, a first accumulator for accumulating the output from the memory with a first clock, a second accumulator for accumulating the output from the first accumulator N times with a second clock of a frequency more than N times that of the first clock, means for outputting square wave signals of frequencies 1 to N times with the most significant bit of the second accumulator in a time divisional manner, a square wave level memory for storing the levels of the square wave signals respectively corresponding to the degrees thereof, and means for inverting and gating the output from the square wave level memory with the square wave output signal from the second accumulator, wherein symmetrically weighted square waves of frequencies up to N times the fundamental frequency are provided in a time divisional manner.

4. An electronic musical instrument comprising:

a square wave generator which is composed of a memory for storing angular velocity information in the form of a binary code corresponding to each time-divided key code sent out of a key code data assignor, a first accumulator for accumulating the output from the memory with a first clock, a second accumulator for accumulating the output from the first accumulator N times with a second clock of a frequency N times that of the first clock, means for outputting square wave signals of frequencies 1 to N times with the most significant bit of the second accumulator in a time divisional manner, a square wave level memory for storing the levels of the square waves respectively corresponding to the degrees thereof, and means for inverting and gating the output from the square wave level memory with the square wave output signal from the second accumulator, and in which symmetrically weighted square waves of frequencies up to N times the fundamental frequency are provided in a time divisional manner; and a digital filter unit which is composed of a cyclic digital filter supplied with the square waves of up to N degrees from the square wave generator and controlled in its filter intensity by changing the amount of feedback thereto and a filter constant memory for storing the filter constants corresponding to the degree and key code of each of the square waves respectively weighted with coefficients, and in which the output from the filter constant memory is applied to the cyclic digital filter to control the amount of feedback thereto to set its filter characteristic in accordance with the degree and key code of each square wave.

5. An electronic musical instrument according to claim 4, wherein, the cyclic digital filter has the structure that, letting its input and output be represented by $X_n$ and $Y_{n-1}$, respectively, the cyclic digital filter comprises means for substracting the input signal $X_n$ from the output signal $Y_{n-1}$, means for multiplying the subtracting means output by a filter constant k determining the filter intensity and means for adding the output signal $Y_n$ to the multiplying means output, and wherein the output from the adding means is temporarily stored to provide the output signal $Y_{n-1}$ after a certain period of time for input to the subtracting means, thereby to obtain the output signal $Y_{n-1}$ expressed by the difference equation, $$Y_{n-1}=(Y_n-X_n)(1/k)+Y_n.$$

6. An electronic musical instrument comprising:

a square wave generator which is composed of a memory for storing angular velocity information in the form of a binary code corresponding to each time-divided key code sent out of a key code data assignor, a first accumulator for accumulating the output from the memory with a first clock, a second accumulator for accumulating the output from the first accumulator N times with a second clock of a frequency N times that of the first clock, means for outputting square wave signals of frequencies 1 to N times with the most significant bit of the second accumulator in a time divisional manner, a square wave level memory for storing the levels of the square waves respectively corresponding to the degrees thereof, and means for inverting and gating the output from the square wave level memory with the square wave output signal from the second accumulator, and in which symmetrically weighted square waves of frequencies up to N times the fundamental frequency are provided in a time divisional manner;

a digital filter unit which is composed of a cyclic digital filter supplied with the square waves of up to N degrees from the square wave generator and a filter constant memory for storing the filter constants corresponding to the degree and key code of each of the square waves respectively weighted with coefficients, and in which the output from the filter constant memory is applied as a filter constant to the cyclic digital filter to set its filter characteristic in accordance with the degree of each square wave; and means for reducing the "0" the predetermined filter constant corresponding to a high-degree one of the square waves supplied to the cyclic digital filter to suppress the high-degree square wave, limiting the square waves to a frequency band lower than a predetermined value.

7. An electronic musical instrument comprising:

a square wave generator which is composed of a memory for storing angular velocity information in the form of a binary code corresponding to each time-divided key code sent out of a key code data assignor, a first accumulator for accumulating the output from the memory with a first clock, a second accumulator for accumulating the output from the first accumulator N times with a second clock of a frequency N times that of the first clock, means for outputting square wave signals of frequencies 1 to N times with the most significant bit of the second accumulator in a time divisional manner, a square wave level memory for storing the levels of the square waves respectively corresponding to the degrees thereof, and means for inverting and gating the output from the square wave level memory with the square wave output signal from the second accumulator, and in which symmetrically weighted square waves of frequencies up to N times the fundamental frequency are provided in a time divisional manner;

a digital filter unit which is composed of cyclic digital filter supplied with the square waves of up to N degrees from the square wave generator and a filter constant memory for storing the filter constants corresponding to the degree and key code of each of the square waves respectively weighted with coefficients, and in which the output from the filter constant memory is applied to the cyclic digital filter to set its filter characteristic in accordance with the degree of each square wave; and a musical note converter which is composed of an envelope generator supplied with an envelope control signal from the key code data assignor, means for multiplying each of the square waves of 1 to N degrees from the cyclic digital filter by the output from the envelope generator and periodically accumulating square waves of 1 to N degrees respectively added with envelopes, means for periodically accumulating the output from the multiplying and accumulating means for each channel and D-A converting means for converting the output from the multiplying means to a musical waveshape.

8. An electronic musical instrument comprising a key code generator which is composed of means for sequentially scanning with a first clock a plurality of blocks into which a plurality of key switches having contacts to be closed are divided, a priority selector for selectively outputting with a second clock closure information of each block sequentially in accordance with predetermined priority, means for inhibiting the first clock with an operation signal of the priority selector during its operation to temporarily stop the block scanning and means for converting the output from the priority selector and information of the block scanning to key data of a binary code and means for detecting completion of one scanning to output a variable frame signal of one frame time determined by the number of blocks and the number of closed key switches the converting means operating during each time frame.

9. An electronic musical instrument comprising a key code data assignor which is composed of a key code memory for storing a key code sent out of a key code generator generating the key code of a variable frame determined by the number of closed key switches in any of channels of the same number as a maximum number of sounds simultaneously produced and outputting a time-divided key code at a clock speed more than several times the number of the channels, a new key code memory for comparing the key code from the key code generator with the time-divided key code from the key code memory to detect and temporarily store the key code of a newly closed key switch, means for providing a content presence or absence signal indicative of the presence or absence of the content of the channel of the key code memory and means for detecting an empty channel of the key code memory by the content presence or absence signal providing means to transfer the key code stored in the new key code memory to the empty channel at the time of a frame signal being provided.

10. An electronic musical instrument comprising:

a key code data assignor which is composed of a key code memory for storing a key code sent out of a key code generator generating the key code of a variable frame determined by the number of closed key switches in any of channels of the same number as a maximum number of sounds simultaneously produced and outputting a time-divided key code at a clock speed more than several times the number of the channels, a new key code memory for comparing the key code from the key code generator with the time-divided key code from the key code memory to detect and temporarily store the key code of a newly closed key switch, means for providing a content presence or absence signal indicative of the presence or absence of the content of the channel of the key code memory and means for detecting an empty channel of the key code memory by the content presence or absence signal providing means to transfer the key code stored in the new key code memory to the empty channel at the time of a frame signal being provided; and a key code data assignor which is composed of an OFF memory for detecting a key OFF one of the channels the key code memory at the time of the frame signal to temporarily store the keyed OFF state and provide an envelope release signal, an envelope end memory for temporarily storing envelope completion and means for clearing the channel with the output from the envelope end memory at the time of the frame signal being provided.

11. An electronic musical instrument comprising an overflow control circuit which is composed of a key code data assignor having means for generating time-divided key codes from a key code generator corresponding to a plurality of channels and generating an overflow signal when key codes more than empty channels are provided from the key code generator, an envelope generator controlled by the key code data assignor to provide envelope data of each of the plurality of channels, a comparison level memory for storing as comparison level data A the time-divided envelope data of a desired channel from the envelope generator, a comparator supplied with the time-divided envelope data in parallel with the comparison level memory to compare the next time-divided envelope data identified as comparison level data B with the comparison level A outputted from the comparison level memory, means for storing the comparison level data B in the comparison level memory when A>B, means for selecting and outputting in a time divisional manner a signal of a minimum level provided from the comparator at the end of one period of all channel detection, a minimum level channel detector for detecting a channel of the minimum level with the time-divided output and means for applying the output from the detector to the envelope generator with the arrival of the overflow signal from the key code data assignor to cause a highspeed release.

12. An electronic musical instrument comprising:

a square wave generator which is composed of a memory for storing angular velocity information in the form of a binary code corresponding to each time-divided key code sent out of key code data assignor, a first accumulator for accumulating the output from the memory with a first clock, a second accumulator for accumulating the output from the first accumulator N times with a second clock of a frequency more than N times that of the first clock, means for outputting square wave signals of frequencies 1 to N times with the most significant bit of the second accumulator in a time divisional manner, a first square wave level memory for storing the levels of the square wave signals respectively corresponding to the degrees thereof, and means for inverting and gating the output from the first square wave level memory with the square wave output signal from the second accumulator, and in which symmetrically weighted square waves of frequencies up to N times the fundamental frequency are provided in a time divisional manner; and a square wave level memory unit which is composed of a priority selector for selectively outputting closure information of tablet switches sequentially in predetermined priority with the first clock, means for sequentially reading out with the first clock the contents of a second square wave level memory respectively corresponding to the tablet switches, means for sequentially accumulating the read out data, and means for transferring the accumulated data to the first square wave level memory after the contents of the second square wave level memory are all read out, and in which the accumulated data transfer time is determined by the number of tablet switches turned ON.

* * * * *

Notice of Adverse Decision in Interference

In Interference No. 100,869, involving Patent No. 4,185,529, H. Kitagawa, ELECTRONIC MUSICAL INSTRUMENT, final judgment adverse to the patentee was rendered Dec. 19, 1983, as to claim 1.

[*Official Gazette June 5, 1984.*]